US006012201A

United States Patent [19]

Mitts et al.

[11] Patent Number: 6,012,201

[45] Date of Patent: Jan. 11, 2000

[54] DOOR HINGE SYSTEM

[75] Inventors: Richard K. Mitts, Fullerton; Warren H. Miller, Claremont, both of Calif.

[73] Assignee: Illinois Tool Works, Inc., Glenview, Ill.

[21] Appl. No.: 09/130,872

[22] Filed: Aug. 7, 1998

[51] Int. Cl.[7] ..... E05D 11/10

[52] U.S. Cl. ..... 16/334; 16/332

[58] Field of Search ..... 16/334, 374, 328, 16/331, 332, 284

[56] References Cited

U.S. PATENT DOCUMENTS

| | | | |
|---|---|---|---|
| 472,483 | 4/1892 | Loomis | 16/327 |
| 4,751,766 | 6/1988 | Fahs et al. | 16/332 |
| 4,794,669 | 1/1989 | Sanders | 16/375 |
| 4,800,624 | 1/1989 | Whitefoot et al. | 16/332 |
| 5,054,165 | 10/1991 | Marchione | 16/270 |
| 5,067,201 | 11/1991 | Marchione | 16/270 |

*Primary Examiner*—Chuck Y. Mah
*Attorney, Agent, or Firm*—George J. Netter

[57] ABSTRACT

A door hinge pad (12) and body hinge pad (14) are respectively mounted on the door and body of an automotive vehicle, and interrelated for relative swinging movement by a pivot pin (16). A pair of spaced apart camming surfaces 30 integral with the door hinge pad (12) are resiliently tracked by first and second rollers (68) connected to opposite ends of a compression spring (66) integrally related to the body hinge pad (14). Swinging movement of the door hinge pad (12) away from the closed position moves the rollers (68) over a camming raised portion into a dwell (34) serving as a limit stop at a predetermined door opening angle.

11 Claims, 3 Drawing Sheets

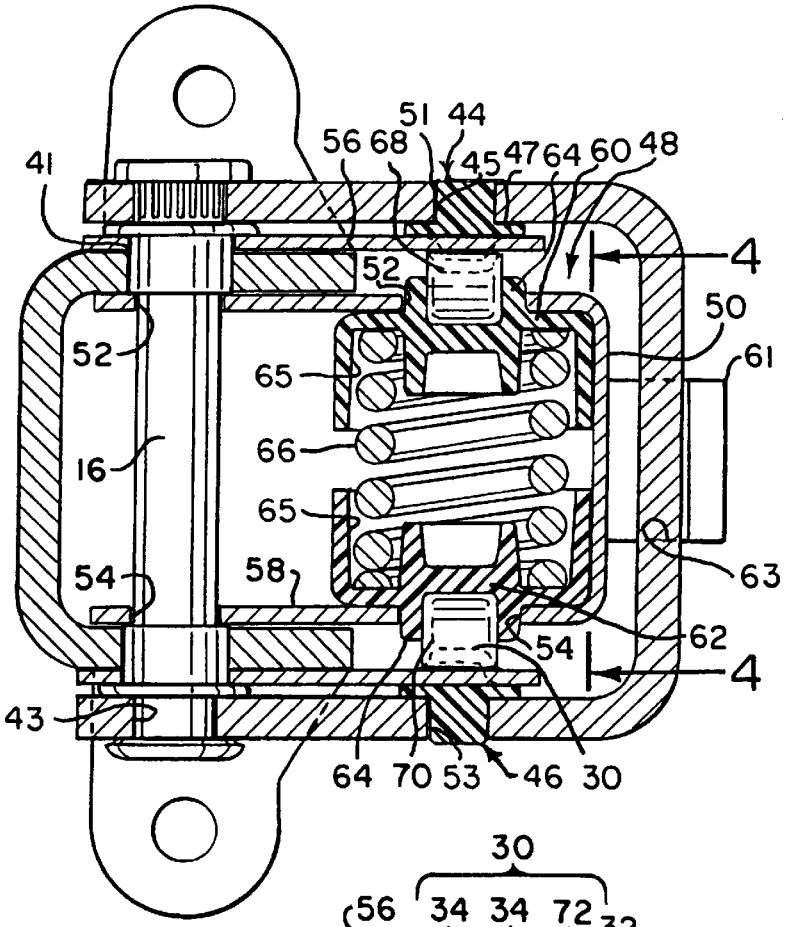
FIG.3
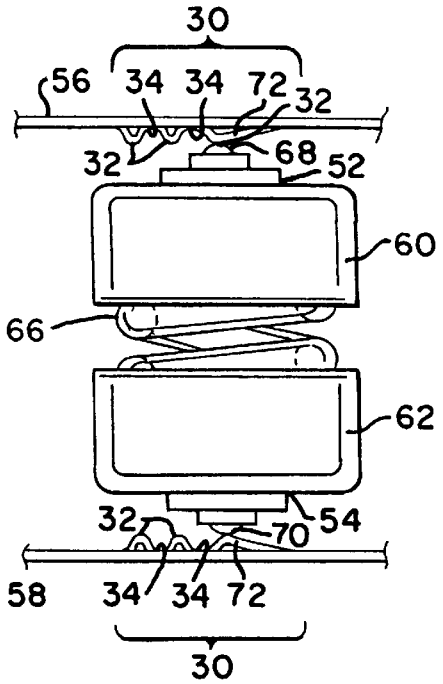
FIG.4
FIG.5
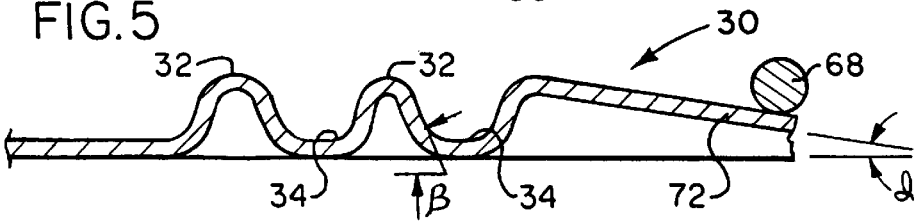

DOOR HINGE SYSTEM

BACKGROUND OF THE INVENTION

1. Field of the Invention

The present invention relates generally to a door hinge system, and, more specifically, to such a system providing one or more different angular door stops of predetermined opening magnitudes for the door.

2. Description of Related Art

Door hinge systems and particularly automotive vehicle door hinges are known to utilize spring devices functioning to aid movement of the door away from an open position to a fully closed position. Illustrative of known art in this area is U.S. Pat. No. 4,800,624, HINGE WITH ELASTOMERICALLY SUPPORTED CHECK SPRING, in which a metal leaf spring is provided with backup by a molded block of a resilient plastic material for the purpose of effecting reduction in metal spring construction required to achieve a desired predetermined spring action.

Although many different versions of door hinge systems or door check systems exist they have not been found to be completely satisfactory. A common difficulty with known systems is that where a modification of the door opening angle or angles is desired it requires the entire system to be revised at a correspondingly high cost.

SUMMARY OF THE INVENTION

In accordance with the practice of the present invention the door hinge apparatus includes a door hinge pad and a body hinge pad, respectively mounted to the door and body by conventional bolt means, for example. The two pads are interrelated by a pivot pin for providing swinging movement with respect to one another.

First and second identical camming means are affixed to first and second spaced apart guide plates which move with the door hinge pad as it moves about the pivot pin. A compression spring assembly mounted onto the body hinge pad has first and second force exerting members or detents that, respectively, contact the first and second camming means which provides a resilient force resisting relative pivoting movement of the door hinge pad with respect to the body hinge pad.

The camming means each have raised camming surfaces separated by lower surfaces or dwells, the spacing between adjacent dwells determining a predetermined angular amount of door intermediate opening position or check. Change of door check angle or angles can be accomplished merely by changing the camming means.

In a further embodiment of the invention the camming means have entrance portions leading into the raised surfaces which are relatively small angles so that opening the door to, say, a first stop requires a relatively small amount of force. However, the slope from a dwell to an adjacent camming means raised surface has a relatively large angle which serves to maintain the door at a given stop position against inadvertent closing from slight forces applied thereto.

BRIEF DESCRIPTION OF THE DRAWING

The ensuing description of preferred embodiments of the present invention can be more particularly understood by those skilled in the appertaining arts on making reference to the following description with further reference made to the accompanying drawing in which:

FIG. 3 is an elevational, sectional view of the hinge apparatus taken through the coil spring and camming means;

FIG. 4 is a side elevational, sectional view taken along the line 4—4 of FIG. 3;

FIG. 5 is an enlarged side elevational view of the camming means and detent roller.

DESCRIPTION OF PREFERRED EMBODIMENTS

Figure 1:
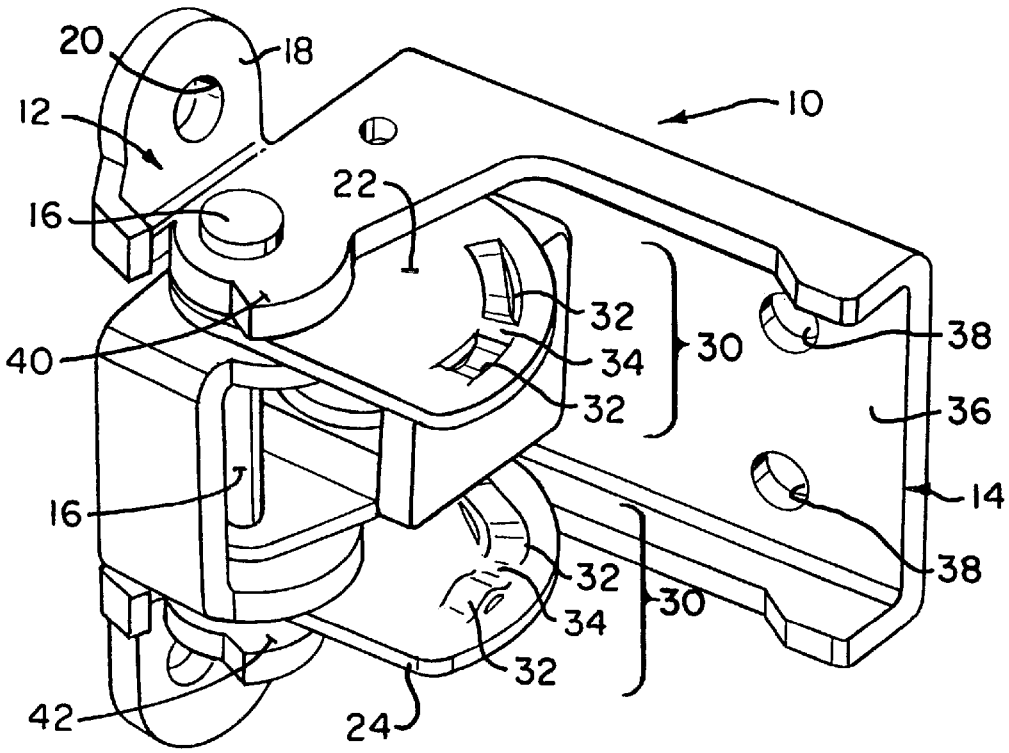
FIG. 1 is a perspective view of hinge apparatus for use in the system of the present invention depicted in closed-door node.

With reference now to the drawing and particularly FIG. 1, there is shown a door hinge apparatus of the present invention enumerated generally as 10, which apparatus is particularly adapted for use on an automotive vehicle door. Since the general construction and operational relation of a door to the body of an automotive vehicle are well-known, the automotive vehicle itself is not depicted in the drawing.

The apparatus 10 includes in its major parts a door hinge pad 12 which, as the name implies, is secured to the door, and a body hinge pad 14 for being secured to the body of the vehicle. The pads can be secured to the door and body by conventional means, e.g., bolts, threaded screws. A pivot pin 16 interrelates the door hinge pad and body hinge pad for relative angular rotation with respect to each other, as will be described later, in opening and closing of the vehicle door.

Figure 2:
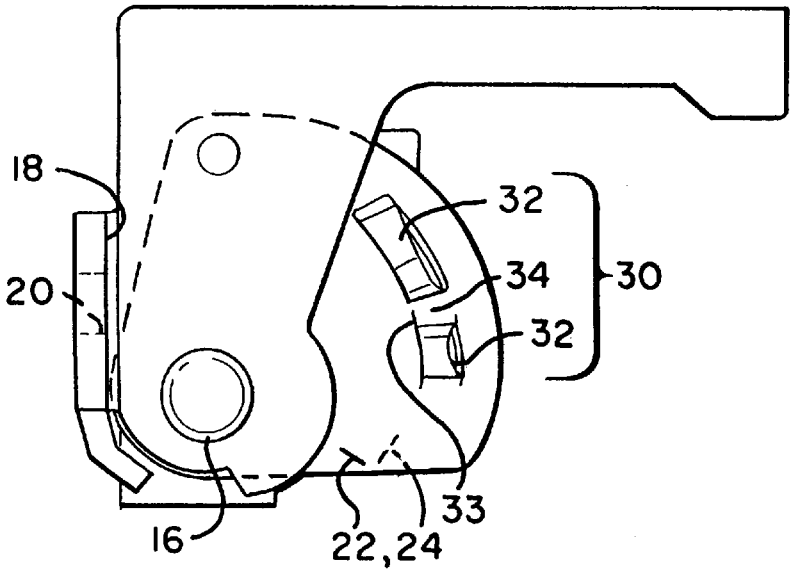
FIG. 2 is a top plan view of FIG. 1.
Figure 6:
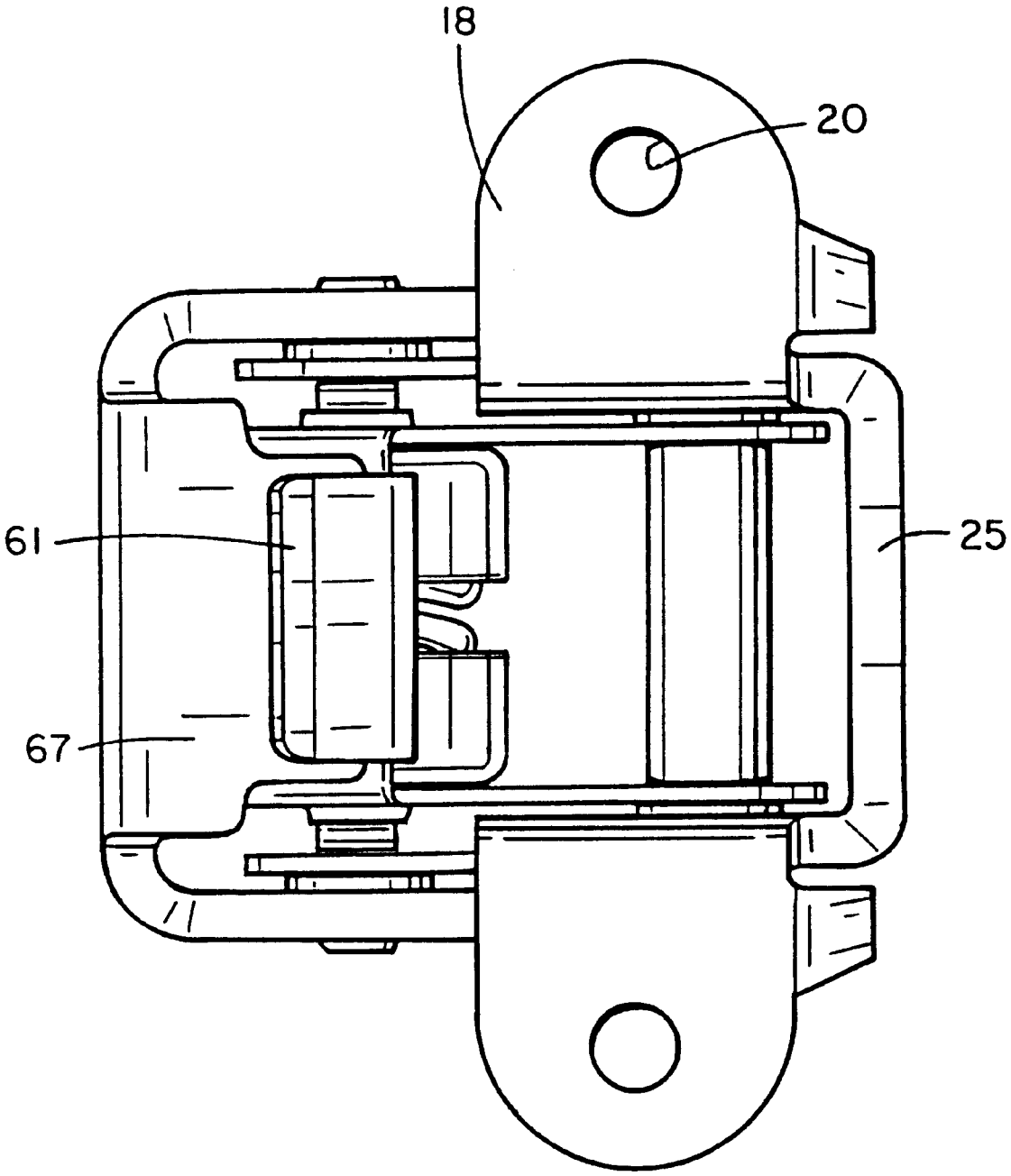
FIG. 6 is a left elevational view of FIG. 1.

With simultaneous reference to FIG. 2, the door pad 12 is seen to include a relatively flat mounting plate means 18 having openings 20 via which the plate means is secured to a part of a door. First and second guide plates 22 and 24 are supported by and extend away in a common direction from the plate means 18 in spaced apart generally parallel relation to one another. More particularly, a generally U-shaped bracket 26 is unitary with the plate means 18 and has the guide plates 22 and 24 affixed (e.g., riveted) to oppositely facing surfaces of its two side arms 28 (FIG. 6). Corresponding openings in the bracket side arms are aligned with one another and so dimensioned as to receive the pivot pin 16 therethrough in final assembled condition. By this construction, the door pad 12 and guide plates 22 and 24 pivot as a unit about the pin 16 and, therefore, in relative movement with respect to the body pad 14.

As shown in FIGS. 2 and 4, each of the facing major surfaces of the guide plates 22 and 24 includes a camming means 30 which consists essentially of a plurality of raised portions 32 in spaced apart relation arranged along an arcuate path 33 and separated by intervening lower portions or dwells 34. When viewed in plan (FIG. 2), the entire camming surface is seen to be continuously curved and the portions 34 will, in a way to be described, serve to form dwell points defining predetermined angular open conditions or "stops" for the door. It is important to note that with reference to the pivot pin 16 the camming surfaces lie along the generally circular arc or curve 33 with the pivot pin being the center for the curve. As can be seen best in FIG. 4, the two sets of camming means 30 are located, respectively, on the inner surfaces of guide plates 22 and 24 facing one another. Moreover, as will be more particularly described later, these camming means coact with parts carried by the body pad 14 to provide limit stops to door opening and closing.

Turning now to FIGS. 1 and 3, the body hinge pad 14 is seen to include a mounting plate 36 having openings 38 therein via which threaded members, such as bolts, can secure the hinge pad to the vehicle body (not shown). First and second support arms 40 and 42 extend away from a common surface of the mounting plate 36 and are in spaced apart relation of sufficient dimensions as to permit being received onto the door hinge pad 12 and sliding adjacent to and outside of the first and second guide plates 22 and 24. Suitable openings 41 and 43 are provided in the first support plate 40 and support plate 42 aligned with each other and for receipt on the pivot pin 16.

A means 48 for applying and maintaining a resilient force between the two hinge pads is shown in sectional view in FIG. 3. More particularly, the means 48 includes a generally U-shaped bracket 50 with openings 52 and 54 in its two side arms 56 and 58, which openings are generally aligned with one another. First and second generally cylindrical end cups 60 and 62 each includes an outer axially located positioning member 64 which is so dimensioned as to be snugly received within the corresponding openings 52 and 54. Concave portions 65 of the two end cups face one another from opposite sides of the U-shaped bracket 50. A compression coil spring 66 has its opposite ends received within the concave portions 65 of the two opposed end cups 60 and 62.

Still further, a hook-shaped member 61 integral with the U-shaped bracket 50 (FIGS. 3 and 6) extends over and clamping onto an edge of a wall portion 67 of the body hinge pad 14 securing the means 48 against relative movement during opening and closing of the door.

Rollers 68 and 70 are secured, respectively, to the outer ends of the positioning members 64 and when fully assembled they provide resilient rolling contact with the camming means carried by the first and second guide plates 22 and 24 of the door hinge pad. The dimensions of the parts and coaction of coil spring 64 are such that the rollers are resiliently forced into contact at all times with the guide plates inwardly facing surfaces or the camming means inwardly facing surfaces, as the case may be. The resilient force caused by the coil spring serves to firmly position the device in the dwell points between the camming maximum extensions and, therefore, position the door at its predetermined opening "check" angles.

It is a further and advantageous aspect of the invention that both ends of coil spring 66 are used in actively engaging the means 30 which doubles the torque achieved. This latter feature increases reliability of operation and long life of dwell point angular definition.

Moreover, first and second guide plate supports 44 and 46, each having a uniform cylindrical body portion 45 and an enlarged head 47 at one end, have their body portions respectively received within openings 51 and 53 in the support arms 40 and 42. The guide plate supports are so dimensioned as to continuously slidingly contact the outwardly directed surfaces of the guide plates 22 and 24 which maintains uniform balance of forces exerted on the guide plates throughout use.

In the described preferred embodiment, two dwell points exist on the camming means 30 which correspond to two different angular open positions at which the door will normally tend to stop and remain during door opening or closing unless overriding opening or closing force, as the case may be, is applied to the door. It is contemplated that the invention can be advantageously applied to a door having either several opening stops of different angular extents or just a single opening stop of selective angular amount.

Still further, the present invention can be modified to provide one or more stops or dwells of different selected angularity merely by changing the camming means 30. In this case, all other parts of the apparatus can remain the same. Accordingly, this enables an automotive vehicle manufacturer to use a single door check apparatus with changed camming means to accommodate several different models of vehicles resulting in overall substantial cost reduction.

FIG. 5 shows an enlarged elevational view of the camming means 30 raised portion 32 and adjacent dwell 34 in closed door mode. It will be noted that the entrance ramp 72 has a relatively gradual rise angle A as compared to a very steep rise angle B that is encountered by a roller as it leaves the dwell. By this construction, a relatively small force is required to open the door and move the roller along the entrance ramp 72, over the camming means raised portion 32 and into a dwell 34. However, it takes a substantially greater amount of force on the door to move it from a dwell back to the entrance ramp and to the closed position. This latter feature makes it more difficult to inadvertently close the door as an individual leaves the vehicle, all in the interests of safety and convenience. Also, further opening movement of the door from a dwell 34 is resisted by a substantial force, and, in that way, prevents undesirable outward loose swinging movement of the door.

Although the present invention has been described in connection with a preferred embodiment, it is to be understood that those skilled in the art may provide modifications which come within the spirit of the invention as described and within the ambit of the appended claims.

What is claimed is:

1. Hinge apparatus interrelating a door to a vehicle body and providing an intermediate door opening dwell point, comprising:

a door hinge pad;

a body hinge pad;

a pivot pin interconnecting said door and body hinge pads providing swinging movement with respect to each other;

first and second camming means mounted to the door hinge pad in spaced apart relation with respective camming surfaces facing each other;

first and second detent rollers contacting the first and second camming means camming surfaces, respectively; and resilient force means having first and second force exerting ends respectively urging the first and second detent rollers against the camming surfaces and including a generally U-shaped member secured to the body hinge pad having first and second spaced apart side arms, each side arm having an opening therein;

a coil spring having first and second force exerting ends;

first and second end cups received on the respective coil spring ends;

the first and second detent rollers being secured respectively to the end cups and having convexly curved parts continuously contacting the camming means throughout relative swinging movement of the door and body hinge pads.

2. Hinge apparatus as in claim 1, in which a hooklike member affixed to the U-shaped member extends clampingly about a wall portion of the body hinge pad securing the U-shaped member and body hinge pad to one another.

3. Hinge apparatus as in claim 1, in which the door hinge pad includes first and second spaced apart guide plates with the first and second camming means being located respectively on facing surfaces of said guide plates.

4. Hinge apparatus as in claim 1, in which a hooklike member affixed to the U-shaped member extends clampingly about a wall portion of the body hinge pad securing the U-shaped member and body hinge pad to one another.

5. Hinge apparatus as in claim 4, in which each support includes a uniform generally cylindrical body portion and an enlarged head for contacting a guide plate.

6. Hinge apparatus as in claim 1, in which the camming surface includes at least two raised portions separated by a dwell.

7. Hinge apparatus as in claim 6, in which each camming surface includes a relatively small-angle entrance ramp to the first encountered raised portion on swinging the door from closed to open positions.

8. A door hinge system for pivotally interconnecting a door with a body, comprising:

door pad means including integrally related first and second spaced apart guide plates;

first and second camming means mounted respectively on facing surfaces of said first and second guide plates;

a body pad;

resilient force exerting means mounted to the body pad having two force exerting ends and including a coil spring, first and second end cups received on opposite ends of the spring, a U-shaped bracket with side arms holding the end cups and compressed spring therebetween, and a hook-like member integral with the U-shaped bracket securing said bracket to the body pad;

first and second rollers mounted respectively on the force exerting means respectively resiliently contacting the first and second camming means; and a pivot pin interconnecting the door pad means and body pad enabling relative continuous pivoting movement with respect to one another between a closed position and a prescribed open position.

9. A door hinge system as in claim 8, in which the U-shaped bracket side arms include first and second aligned openings and said end cups have parts that are fittingly received within said aligned openings.

10. A hinge system for pivotally interconnecting a door to an automotive vehicle body and providing a releasable limit stop intermediate the door fully closed and fully open positions, comprising:

door pad means including a mounting plate for securement to the door;

first and second spaced apart guide plates integral with the door pad means and having surfaces facing one another, each of said guide plates having an opening with said openings being aligned;

identical camming means formed in portions of the facing surfaces of both guide plates;

body pad means including a mounting plate for securement to the vehicle body;

first and second spaced apart support arms integral with the body pad means mounting plate and extending in the same direction away from a common surface of the said mounting plate, said support arms being so spaced as to slide outside the respective guide plates and having openings that align with the openings of the guide plates;

a pivot pin received within the guide plate openings and aligned support arm openings;

a generally U-shaped bracket having a cross-bar member affixed to the door pad means mounting plate with bracket side arms extending between the door pad means guide plates, said side arms including aligned openings;

a roller mounted within each side arm opening; and compression spring means mounted between the side arms and simultaneously resiliently urging both rollers outwardly into contact with the respective camming means.

11. A hinge system as in claim 10, in which the compression spring means includes first and second end cups, each with convex and concave sides, said convex sides being fittingly received within the respective openings in the bracket side arms, which cups each have outwardly directed parts on the convex side for receiving a roller therein; a coil spring with end portions simultaneously engaging each end cup concave side and resiliently urging said cups away from each other.

* * * * *